US010499474B1

(12) United States Patent
Chen et al.

(10) Patent No.: US 10,499,474 B1
(45) Date of Patent: Dec. 3, 2019

(54) DRIVER CIRCUIT AND DRIVING METHOD WITH LOW INRUSH CURRENT

(71) Applicant: ANPEC ELECTRONICS CORPORATION, Hsinchu (TW)

(72) Inventors: Chih-Ning Chen, Taipei (TW); Chih-Heng Su, Hsinchu (TW); Hung-Wen Lu, Hsinchu (TW)

(73) Assignee: ANPEC ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 16/280,236

(22) Filed: Feb. 20, 2019

(30) Foreign Application Priority Data

Oct. 11, 2018 (TW) ..... 107135796 A

(51) Int. Cl.
*H05B 33/08* (2006.01)

(52) U.S. Cl.
CPC ..... *H05B 33/0884* (2013.01)

(58) Field of Classification Search
CPC ..... H05B 33/0884
USPC ..... 315/122
See application file for complete search history.

(56) References Cited

U.S. PATENT DOCUMENTS

2012/0049754 A1* 3/2012 Suzuki ..... H02M 3/158 315/224
2012/0074924 A1* 3/2012 Dequina ..... H02M 3/156 323/351
2014/0042992 A1* 2/2014 Takata ..... H02M 1/4225 323/211
2017/0288552 A1* 10/2017 Hari ..... H02M 3/33507

FOREIGN PATENT DOCUMENTS

TW 201349725 A 12/2013

* cited by examiner

*Primary Examiner* — Don P Le
(74) *Attorney, Agent, or Firm* — Li & Cai Intellectual Property (USA) Office

(57) ABSTRACT

A driver circuit and a driving method with low inrush current are provided. The driving method includes steps of: supplying a charging current smaller than a high inrush current; outputting a pulse signal from a pulse generating circuit; enabling a light driving circuit to receive the charging current by the pulse signal and allowing the charging current to flow to an storage capacitor; turning on a switch component and a light-emitting assembly by the pulse signal; supplying an auxiliary current smaller than the high inrush current; enabling the light driving circuit to receive the auxiliary current and allowing auxiliary current to flow sequentially to the switch component and the light-emitting assembly; and emitting light by the light-emitting assembly with the discharging current of the storage capacitor and the auxiliary current of input power source.

9 Claims, 7 Drawing Sheets

DRIVER CIRCUIT AND DRIVING METHOD WITH LOW INRUSH CURRENT

CROSS-REFERENCE TO RELATED PATENT APPLICATION

This application claims the benefit of priority to Taiwan Patent Application No. 107135796, filed on Oct. 11, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a circuit and a method for driving a light-emitting component to emit light, and in particular to a driver circuit and a driving method with low inrush current, which sequentially supply a plurality of low inrush current divided from a high inrush current to drive the light-emitting components to emit light.

BACKGROUND OF THE DISCLOSURE

Inrush current often cause problems in power supply circuits. The inrush current is usually generated at the moment when a driver circuit is turned on by the power supply circuit. Excessive transient current at that moment generates noise in the driver circuit and may even damage the driver circuit or loads.

SUMMARY OF THE DISCLOSURE

In response to the above-referenced technical inadequacies, the present disclosure provides a driver circuit with low inrush current, which includes a pulse generating circuit, a light driving circuit, an output inductor, a storage capacitor, a switch component and a light-emitting assembly. The pulse generating circuit is configured to output a pulse signal and a next pulse signal. The light driving circuit is connected to the pulse generating circuit and an input power source. The light driving circuit is configured to receive the pulse signal from the pulse generating circuit, and sequentially receive the charging current and an auxiliary current from the input power source. Each of the charging current and the auxiliary current is smaller than a high inrush current. The output inductor has one terminal connected to the light driving circuit. The storage capacitor has one terminal connected to the other terminal of the output inductor and another terminal grounded. The storage capacitor is configured to receive the charging current and be discharged to supply a discharging current based on the charging current. The switch component has one terminal connected between the other terminal of the output inductor and the one terminal of the storage capacitor. The light-emitting assembly is connected in series to the switch component, and the switch component is connected in parallel to the storage capacitor. The light-emitting assembly includes one or more light-emitting components connected in series with each other.

The light-emitting assembly has a positive terminal connected to another terminal of the switch component and a negative terminal grounded. When a voltage level of the pulse signal reaches a reference level, the light driving circuit is configured to allow the charging current to flow to the storage capacitor through the light driving circuit until a voltage of the storage capacitor is charged up to be equal to an input voltage of the input power source. When a predetermined time passes after the voltage of the storage capacitor is charged up to be equal to the input voltage of the input power source, the next pulse signal reaches the reference level to turn on the switch component, and the discharging current of the storage capacitor flows sequentially through the switch component and the light-emitting assembly. The auxiliary current is allowed to flow sequentially to the switch component and the light-emitting assembly through the light driving circuit, such that the light-emitting assembly emits light by using the discharging current and the auxiliary current.

In addition, the present disclosure provides a driving method with low inrush current, including the following steps: supplying a charging current smaller than a high inrush current from an input power source; outputting a pulse signal from a pulse generating circuit; when a voltage level of the pulse signal reaches a reference level, receiving the charging current from the input power source by a light driving circuit, and allowing the charging current to flow to the storage capacitor through the light driving circuit until a voltage of the storage capacitor is charged up to be equal to an input voltage of the input power source; wherein when a predetermined time passes after the voltage of the storage capacitor is charged up to be equal to the input voltage of the input power source, a next pulse signal outputted by the pulse generating circuit reaches the reference level to turn on the switch component. The storage capacitor is discharged and allows the discharging current to flow to a light-emitting assembly through the switch component, and receiving the auxiliary current from the input power source by a light driving circuit, and allowing the auxiliary current to flow sequentially to the switch component and the light-emitting assembly through the light driving circuit; and emitting light by the light-emitting assembly with the discharging current and the auxiliary current As described above, the conventional driving method supplies a high inrush current for a single time to drive the light-emitting assembly to emit light. In contrast, the driver circuit and a driving method with low inrush current of the present disclosure supply the low inrush current sequentially over a number of times, each of which is smaller than a current threshold, to prevent the circuit components from being damaged by an excessively high inrush current flowing at once, so as to extend lifetimes of the circuit components.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
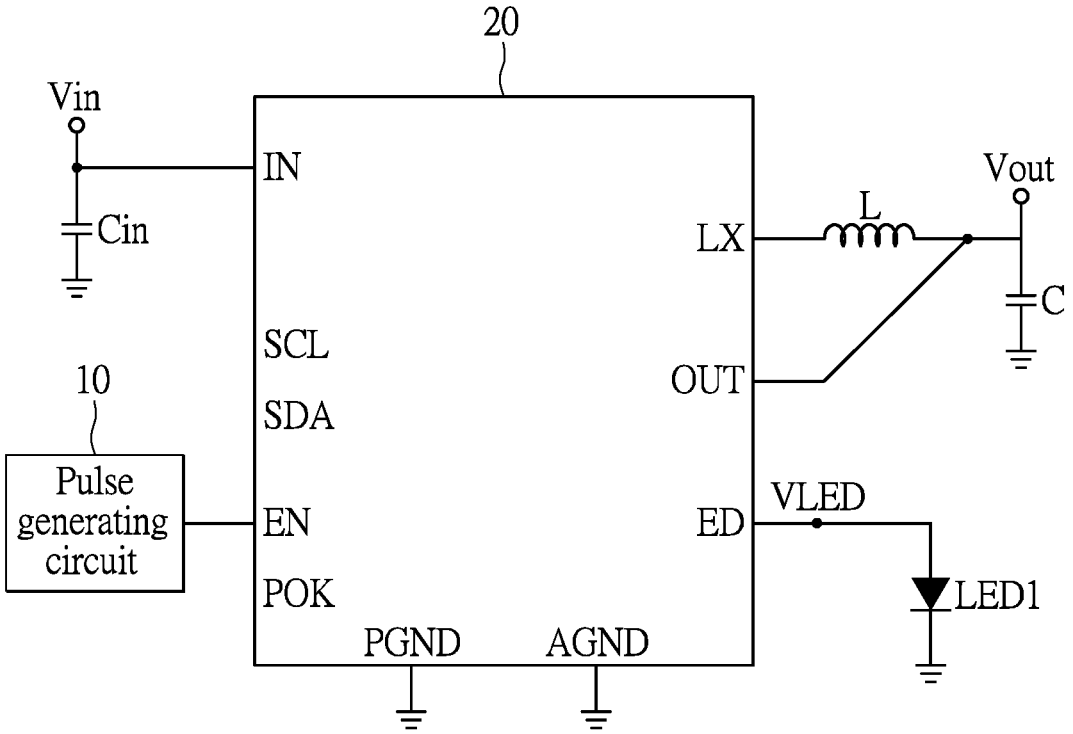
FIG. 1 is a circuit layout of a driver circuit with low inrush current according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1, which is a circuit layout of a driver circuit with low inrush current according to a first embodiment of the present disclosure. As shown in FIG. 1, the driver circuit with the low inrush current includes a pulse generating circuit 10, a light driving circuit 20, an output inductor L, a storage capacitor C, a switch component and a light-emitting diode LED1.

In the embodiment, the light driving circuit 20 has pins IN, SCL, SDA, EN, POK, PGND, AGND, LX, OUT and ED, but the present disclosure is not limited thereto. In practice, the light driving circuit 20 may be replaced with other circuits each having a function of driving the light-emitting component to emit light.

The pin EN of the light driving circuit 20 is connected to an output terminal of the pulse generating circuit 10. One terminal of a capacitor Cin is connected to the pin IN of the light driving circuit 20 and an input voltage source Vin, and another terminal of the capacitor Cin is grounded. In practice, the input voltage source Vin may be replaced with a current source. The pin LX of the light driving circuit 20 is connected to the output inductor L. The output inductor L is connected in series to the capacitor C and grounded through the capacitor C. The pin OUT of the light driving circuit 20 is connected to a node between the output inductor L and the capacitor C. The pin ED of the light driving circuit 20 is connected to a positive terminal of the light-emitting diode LED1, and a negative terminal of the light-emitting diode LED1 is grounded. The pins PGND and AGND of the light driving circuit 20 are grounded.

In addition, a switch component is disposed between the pin OUT and the pin ED of the light driving circuit 20. One terminal of the switch component is connected to the node between the output inductor L and the capacitor C through the pin OUT, and another terminal of the switch component is connected to the positive terminal of the light-emitting diode LED1 through the pin ED.

The pulse generating circuit 10 may continuously supply a pulse signal to the light driving circuit 20. When the pulse signal received by the light driving circuit 20 through the pin EN from the pulse generating circuit 10 does not reach a reference level, for example, a voltage level of the present pulse signal is at a low level, the light driving circuit 20 is not enabled by the pulse generating circuit 10 and thus does not perform any operation. Under this condition, the input voltage Vin may charge the capacitor Cin first.

If the light driving circuit 20 intends to drive the light-emitting diode LED1 to emit light, the pulse generating circuit 10 may output the pulse signal reaching the reference level to turn on the switch component, for example, the voltage level of the pulse signal rises from a low level to a high level for enabling the light driving circuit 20 to receive a discharging current of the capacitor Cin through the pin IN. It is worth noting that the discharging current of the capacitor Cin that is a charging current for charging the storage capacitor C must be smaller than a high inrush current (that is a current threshold). That is, the charging current is a low inrush current.

The light driving circuit 20 may allow the discharging current of the capacitor Cin to flow to the output inductor L through the pin LX of the light driving circuit 20. Then, the discharging current flows to the storage capacitor C to charge the storage capacitor C. When a voltage of the storage capacitor C is charged up to an input voltage of the input voltage source Vin, the light driving circuit 20 stops charging the storage capacitor C.

Then, when a predetermined time passes after the voltage of the storage capacitor C is charged up to the input voltage of the input voltage source Vin, a next pulse signal outputted by the pulse generating circuit 10 reaches the reference level to turn on the switch component. The storage capacitor C may start to be discharged. A discharging current of the storage capacitor C flows to the light driving circuit 20 through the pin OUT. Then, the discharging current flows to the switch component in the light driving circuit 20 between the pin OUT and the pin ED. Under this condition, the switch component allows the discharging current to flow to the light-emitting diode LED1 through the pin ED of the light driving circuit 20 such that the light-emitting diode LED1 lights up.

As described above, the charging current supplied for the first time is limited to being the low inrush current. Therefore, the light driving circuit 20 needs to supply power to the light-emitting diode LED1 via the input voltage source Vin again. A charging path and a discharging path of the supplied current for the second time are described below.

When or after the discharging current of the storage capacitor C flows through the light-emitting diode LED1, the light driving circuit 20 may receive an auxiliary current generated based on the input voltage source Vin from the capacitor Cin. It is worth noting that the auxiliary current must be smaller than the high inrush current. That is, the auxiliary current is a low inrush current.

Then, the light driving circuit 20 may allow the auxiliary current to flow to the output inductor L through internal circuit components of the light driving circuit 20 between the pin IN and pin LX, and then the auxiliary current flows to the pin OUT of the light driving circuit 20. The switch component between the pin OUT and the pin ED may be turned on by the light driving circuit 20 to allow the auxiliary current to flow to the light-emitting diode LED1 through the switch component. At this time, the light-emitting diode LED1 may emit light having desired brightness by using the discharging current of the storage capacitor C and the auxiliary current of the input voltage Vin.

Figure 2:
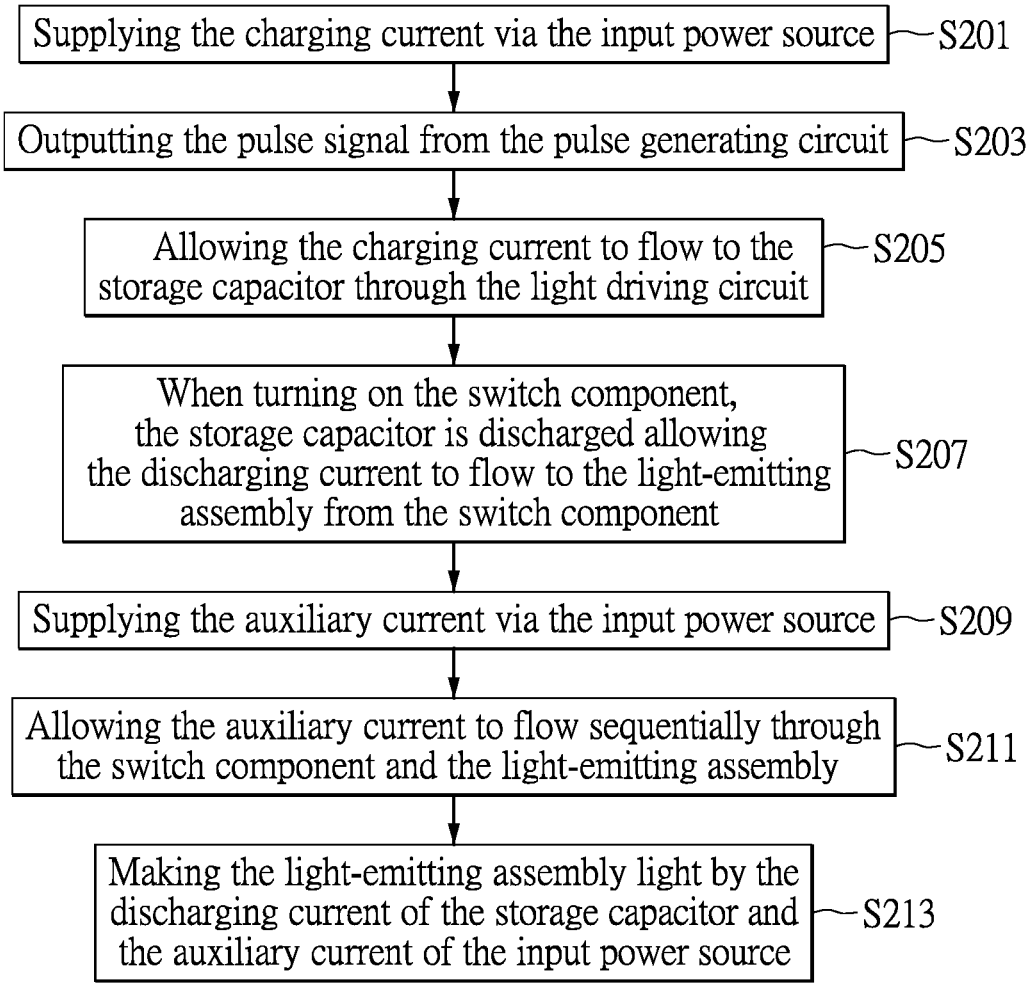
FIG. 2 is a flowchart of a driving method with the low inrush current according to the first embodiment of the present disclosure.

Reference is made to FIG. 2, which is a flowchart of a driving method with the low inrush current according to the first embodiment of the present disclosure. As shown in FIG. 2, in the embodiment, the driving method with the low inrush current includes the following steps S201 to S213.

In step S201, the charging current smaller than the high inrush current is supplied.

In step S203, the pulse generating circuit outputs the pulse signal.

In step S205, when the level of the voltage level of the pulse signal reaches the reference level, the light driving circuit receives the charging current from the input power source, and allows the charging current to flow to the storage capacitor through the light driving circuit, until the voltage of the storage capacitor is charged up to be equal to the input voltage of the input power source.

In step S207, when a predetermined time passes after the voltage of the storage capacitor is charged up to be equal to the input voltage of the input power source, the next pulse signal reaches the reference level to turn on the switch component, the storage capacitor is discharged, and then the discharging current flows to the light-emitting assembly from the switch component.

In step S209, the auxiliary current smaller than the high inrush current is supplied. The supplied auxiliary current in step S209 may have a current value, which is the same as or different from that of the supplied charging current in step S201.

In step S211, the light driving circuit receives the auxiliary current smaller than the high inrush current from the input power source, and allows the auxiliary current to flow sequentially to the switch component and the light-emitting assembly through the light driving circuit.

In step S213, the light-emitting assembly emits light by using the discharging current of the storage capacitor and the auxiliary current of the input power source.

Figure 3A:
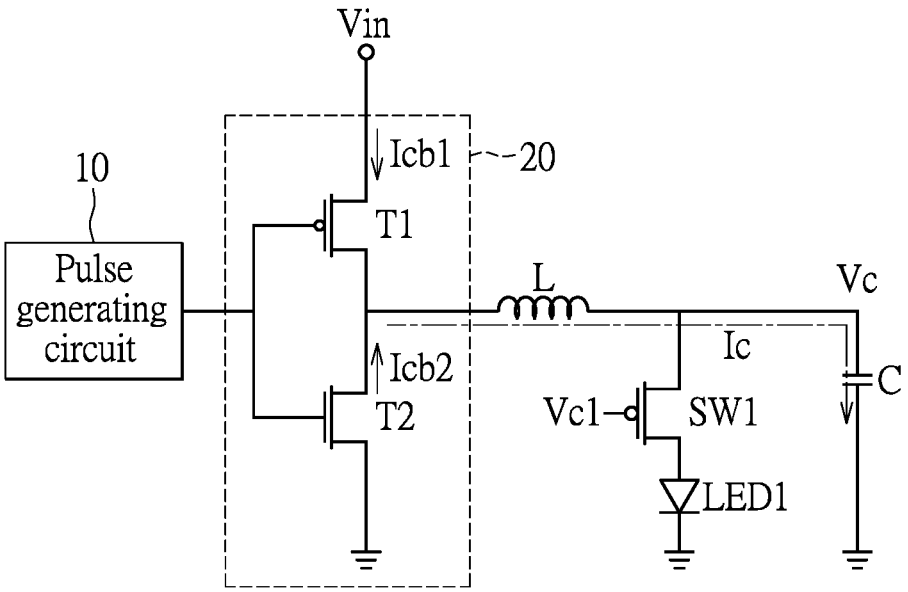
FIG. 3A is a circuit layout of a driver circuit for charging a storage capacitor with low inrush current according to a second embodiment of the present disclosure.

Reference is made to FIG. 3A, which is a circuit layout of a driver circuit for charging a storage capacitor with low inrush current according to a second embodiment of the present disclosure. As shown in FIG. 3A, the driver circuit with the low inrush current includes the pulse generating circuit 10, the light driving circuit 20, the output inductor L, the storage capacitor C, the switch component SW1 and the light-emitting diode LED1. The light driving circuit 20 includes transistors T1 and T2. The storage capacitor C is connected in parallel to a series circuit of the switch component SW1 and light-emitting diode LED1.

The transistor T1 has a first main control terminal, a first power input terminal and a first power output terminal. The transistor T2 has a second main control terminal, a second power input terminal and a second power output terminal. In the embodiment, the transistor T1 is a p-channel MOSFET and T2 is an n-channel MOSFET. Alternatively, the transistors T1 and T2 are n-channel MOSFETs or other types of transistors. Gate terminals of the transistors T1 and T2 are connected to an output terminal of the pulse generating circuit 10. The pulse generating circuit 10 controls operational states of the transistors T1 and T2. A source terminal of the transistor T1 is connected to the input power source Vin. A drain terminal of the transistor T1 is connected to one terminal of the output inductor L, and connected to the capacitor C and the series circuit of the switch component SW1 and the light-emitting diode LED1 through the other terminal of the output inductor L. A drain terminal of the transistor T2 is connected to the drain terminal of the transistor T1 and the one terminal of the output inductor L. A source terminal of the transistor T2 is grounded.

The pulse generating circuit 10 may output the pulse signal, which includes a first pulse signal and a second pulse signal. More specifically, the pulse generating circuit 10 may synchronously or sequentially output the first pulse signal to the transistor T1 and the second pulse signal to the transistor T2. Each of the first pulse signal and the second pulse signal has a plurality of pulse waves. When a voltage level of the first pulse signal received by the transistor T1 reaches a first reference level, the transistor T1 is turned on. As shown in FIG. 3A, the transistor T1 is a PMOS transistor, which can be turned on by the first pulse signal reaching the first reference level representing a low level. Alternatively, the transistor T1 is an NMOS transistor, and the first reference level is a high level. Under this condition, the light driving circuit 20 may allow a supplied first shunt charging current Icb1 to flow to the drain terminal of the transistor T1 from the source terminal of the transistor T1.

When a voltage level of the second pulse signal received by the transistor T2 reaches a second reference level, the transistor T2 is turned on. As shown in FIG. 3A, the transistor T2 is an NMOS transistor, which can be turned on by the second pulse signal reaching the second reference level representing a high level. Alternatively, the transistor T2 is a PMOS transistor, and the second reference level is a low level. Under this condition, the light driving circuit 20 may allow a supplied second shunt charging current Icb2 to flow to the drain terminal of the transistor T2 from the source terminal of the transistor T2.

The first shunt charging current Icb1 and the second shunt charging current Icb2 flow through the output inductor L together from the drain terminals of the transistors T1 and T2 to form a charging current. That is, the charging current is a total current of the first shunt charging current Icb1 and the second shunt charging current Icb2. Then, the charging current flows to the storage capacitor C, until the voltage of the storage capacitor C is charged up to be equal to the input voltage of the input voltage source Vin. For example, a conduction voltage of the switch component SW1 is 0.3 volt, a conduction voltage of the light-emitting diode LED1 is 0.7 volt, and the voltage of the storage capacitor C may be larger than 1 volt, but the present disclosure is not limited thereto.

As described above, the driver circuit with the low inrush current realizes the charging of the storage capacitor C before driving the light-emitting diode LED1 to emit light. Further, a driving operation of the light-emitting diode LED 1 will be described in detail below.

Figure 3B:
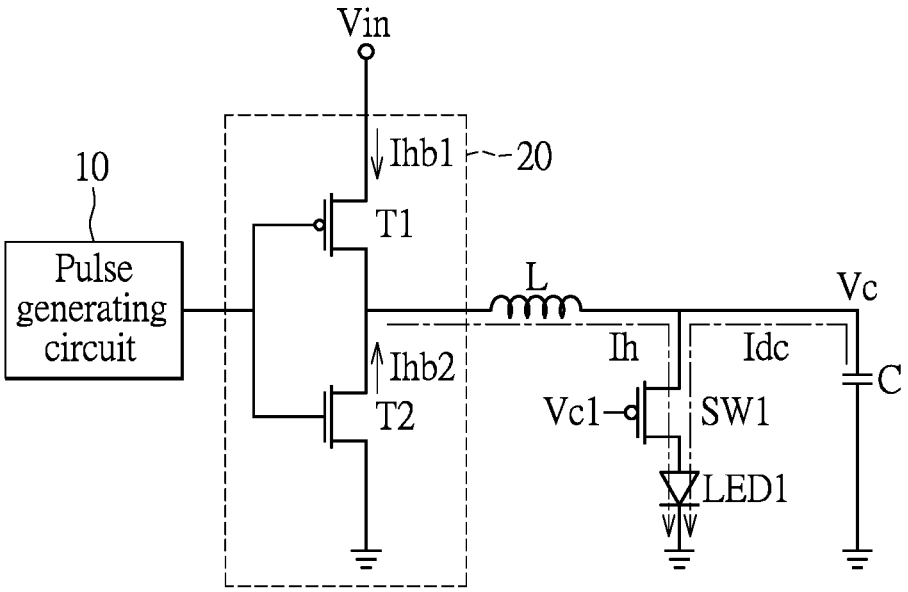
FIG. 3B is a circuit layout of a driver circuit for driving a light-emitting component to emit light with low inrush current according to the second embodiment of the present disclosure.

Reference is made to FIG. 3B, which is a circuit layout of a driver circuit for driving a light-emitting component to emit light with low inrush current according to the second embodiment of the present disclosure. After charging the storage capacitor C by the driver circuit with the low inrush current, as shown in FIG. 3B, the storage capacitor C may start to be discharged. A discharging current Idc of the storage capacitor C flows to the light-emitting diode LED1 through the switch component SW1 from the storage capacitor C to turn on the light-emitting diode LED1 and supply power required for the light-emitting diode LED1.

The pulse generating circuit outputs the next pulse signal, which includes a next first pulse signal and a next second pulse signal. More specifically, the pulse generating circuit 10 may synchronously or sequentially output the next first pulse signal to the transistor T1 and the next second pulse signal to the transistor T2. When a voltage level of the next first pulse signal supplied from the pulse generating circuit 10 reaches the first reference level, and the switch component SW1 and the light-emitting diode LED1 are turned on by the next first pulse signal, the storage capacitor C is discharged. A first shunt auxiliary current Ihb1 supplied by the light driving circuit 20 flows to the drain terminal of the transistor T1 from the source terminal of the transistor T1.

When a voltage level of the next second pulse signal supplied from the pulse generating circuit 10 reaches the second reference level, a second shunt auxiliary current Ihb2 supplied by the light driving circuit 20 flows to the drain terminal of the transistor T2 from the source terminal of the transistor T2.

The first shunt auxiliary current Ihb1 from the drain terminal of the transistor T1 and the second shunt auxiliary current Ihb2 from the drain terminal of the transistor T2 flow to the output inductor L together to form an auxiliary current Ih. That is, the auxiliary current Ih is a total current of the first shunt auxiliary current Ihb1 and the second shunt auxiliary current Ihb2. Then, the auxiliary current Ih flows to the switch component SW1 and the light-emitting diode LED1 to supply enough power required for the light-emitting diode LED1, such that the light-emitting diode LED1 can light up with desired brightness.

It is worth noting that each of the above charging current Ic, Icb1 and Icb2 and the auxiliary current Ih, Ihb1 and Ihb2 is much smaller than the high inrush current.

Figure 3C:
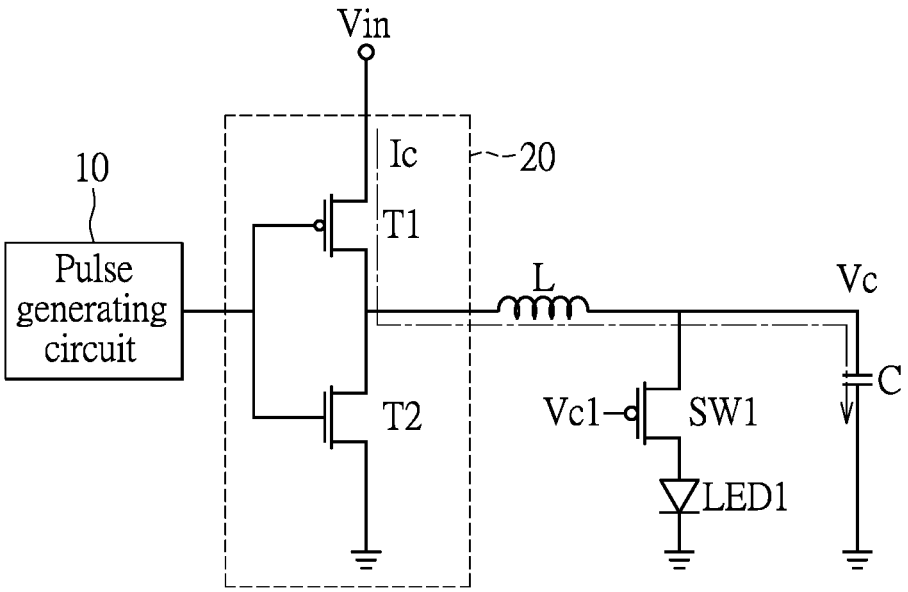
FIG. 3C is a circuit layout of a driver circuit for charging a storage capacitor with low inrush current according to a third embodiment of the present disclosure.

Reference is made to FIG. 3C, which is a circuit layout of a driver circuit for charging a storage capacitor with low inrush current according to a third embodiment of the present disclosure. As shown in FIG. 3C, the driver circuit with the low inrush current includes the pulse generating circuit 10, the light driving circuit 20, the output inductor L, the storage capacitor C, the switch component SW1 and the light-emitting diode LED1. The light driving circuit 20 includes the transistors T1 and T2. The storage capacitor C is connected in parallel to the series circuit of the switch component SW1 and light-emitting diode LED1.

When a voltage level of the first pulse signal received by the transistor T1 reaches the first reference level such as the low level, the transistor T1 is turned on by the first pulse signal. At this time, the light driving circuit 20 supplies the charging current Ic to the storage capacitor C through the transistor T1 to charge the storage capacitor C. The charging current Ic may be equal to the first shunt charging current Icb1 as shown in FIG. 3A.

Differences between the first embodiment and the second embodiment are that, in the second embodiment, when the transistor T1 supplies the charging current Ic, a voltage level of the second pulse signal received by the transistor T2 from the pulse generating circuit 10 is not equal to the second reference level, for example, the second pulse signal is at a low level such that the transistor T2 is turned off. Therefore, the transistor T2 of the light driving circuit 20 does not supply any charging current (such as the above second shunt charging current Icb2 as shown in FIG. 3A) to the storage capacitor C.

Figure 3D:
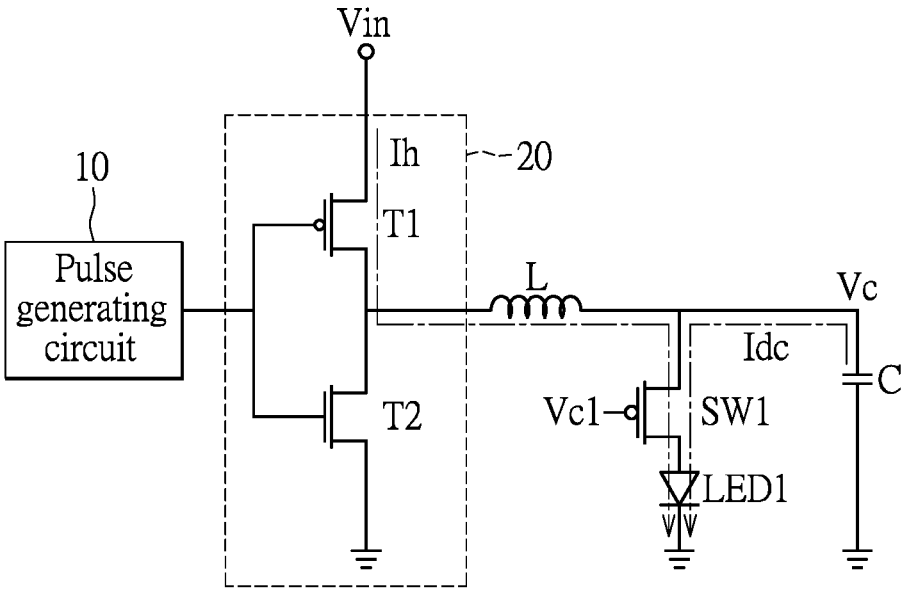
FIG. 3D is a circuit layout of a driver circuit for driving a light-emitting component to emit light with low inrush current according to the third embodiment of the present disclosure.

Reference is made to FIG. 3D, which is a circuit layout of a driver circuit for driving a light-emitting component to emit light with low inrush current according to the third embodiment of the present disclosure.

Differences between the third embodiment as shown in FIG. 3D and the second embodiment as shown in FIG. 3B are that, in the third embodiment, the transistor T1 is turned on to allow the charging current Ic to be supplied through the transistor T1, but the transistor T2 is turned off, thereby saving power. The discharging current Idc of the storage capacitor C and the auxiliary current Ih flowing through the transistor T1 are synchronously supplied to the switch component SW1 and the light-emitting diode LED1 such that the light-emitting diode LED1 lights up.

It should be understood that those skilled in the art should be able to implement one or more combinations of some or all of the disclosed contents in the embodiments, with reference to the detailed descriptions of the embodiments herein. For example, the disclosed contents in the second embodiment as shown in FIG. 3A may be combined with the disclosed contents in the third embodiment as shown in FIG. 3D. Alternatively, the disclosed contents in the second embodiment as shown in FIG. 3C may be combined with the disclosed contents in the third embodiment as shown in FIG. 3B.

Figure 4:
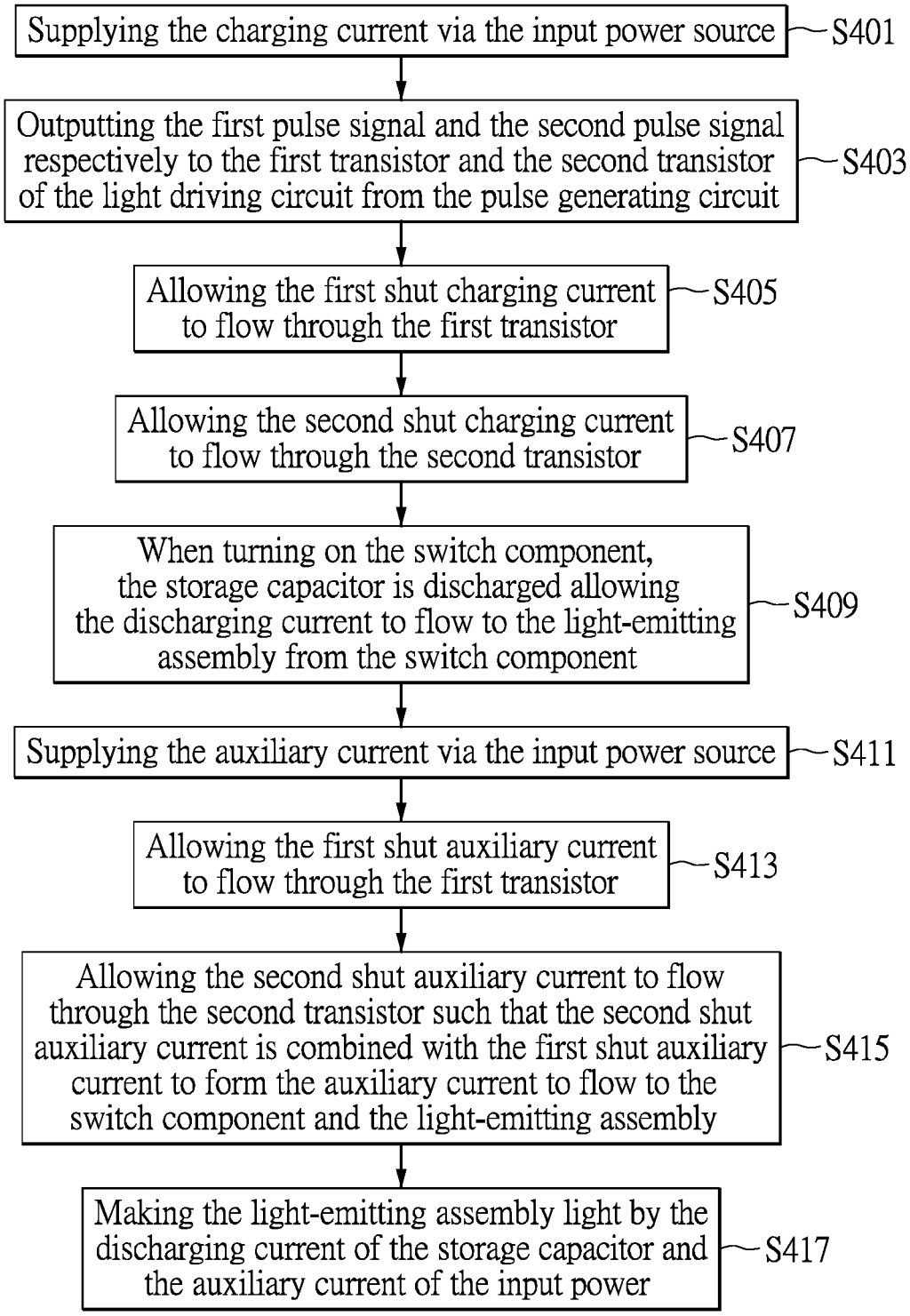
FIG. 4 is a flowchart of a driving method with low inrush current according to a fourth embodiment of the present disclosure.

Reference is made to FIG. 4, which is a flowchart of a driving method with low inrush current according to a fourth embodiment of the present disclosure.

As shown in FIG. 4, in the embodiment, the driving method with the low inrush current includes the following steps S401 to S417 for the driver circuit of the second and third embodiments.

In step S401, the light driving circuit supplies the charging current including the first shunt charging current and the second shunt charging current, each of which is smaller than the high inrush current. The first shunt charging current is supplied from the first transistor of the light driving circuit. The second shunt charging current is supplied from the second transistor of the light driving circuit.

In step S403, the pulse generating circuit outputs the first pulse signal to the first transistor of the light driving circuit, and the second pulse signal to the second transistor of the light driving circuit.

In step S405, when the voltage level of the first pulse signal reaches the first reference level, the first transistor is turned on by the first pulse signal, the first shunt charging current is allowed to flow to the storage capacitor through the first transistor.

In step S407, when the voltage level of the second pulse signal reaches the second reference level, the second transistor is turned on by the second pulse signal, the second shunt charging current is allowed to flow through the second transistor. Then, the second shunt charging current and the first shunt charging current flow together and form the charging current. Then, the charging current flows to the storage capacitor to charge the storage capacitor, until the voltage of the storage capacitor is charged up to be equal to the input voltage of the input power source.

In step S409, when the switch component is turned on by the first pulse signal, the storage capacitor is discharged. And then the discharging current flows to the light-emitting assembly such that the light-emitting component emits light.

In step S411, the light driving circuit supplies the auxiliary current including the first shunt auxiliary current and the second shunt auxiliary current, each of which is smaller than the high inrush current. The first shunt auxiliary current is supplied from the first transistor of the light driving circuit. The second shunt auxiliary current is supplied from the second transistor of the light driving circuit.

In step S413, when the voltage level of the next first pulse signal reaches the first reference level, the first transistor is turned on by the next first pulse signal, the first shunt auxiliary current is allowed to flow to the switch component and the light-emitting assembly.

In step S415, when the voltage level of the next second pulse signal reaches the second reference level, the second transistor is turned on by the next second pulse signal, the second shunt auxiliary current is allowed to flow through the second transistor, and then flow together with the first shunt auxiliary current to form the auxiliary current flowing to the switch component and the light-emitting assembly.

In step S417, the light-emitting assembly emits light by using the discharging current of the storage capacitor and the auxiliary current of the input power.

The driving method may further include the following steps replacing step S407. When a voltage level of the first pulse signal reaches the first reference level and a voltage level of the second pulse signal does not reach the second reference level, the first transistor is turned on and the second transistor is turned off by the pulse generating circuit to allow the first shunt charging current but not the second shunt charging current to flow to the storage capacitor through the first transistor to charge the storage capacitor.

The driving method may further include the following steps replacing step S415. When a voltage level of the first pulse signal reaches the first reference level and a voltage level of the second pulse signal does not reach the second reference level, the first transistor is turned on and the second transistor is turned off by the pulse generating circuit to allow the first shunt auxiliary current but not the second shunt auxiliary current to flow to the switch component and the light-emitting assembly.

Figure 5:
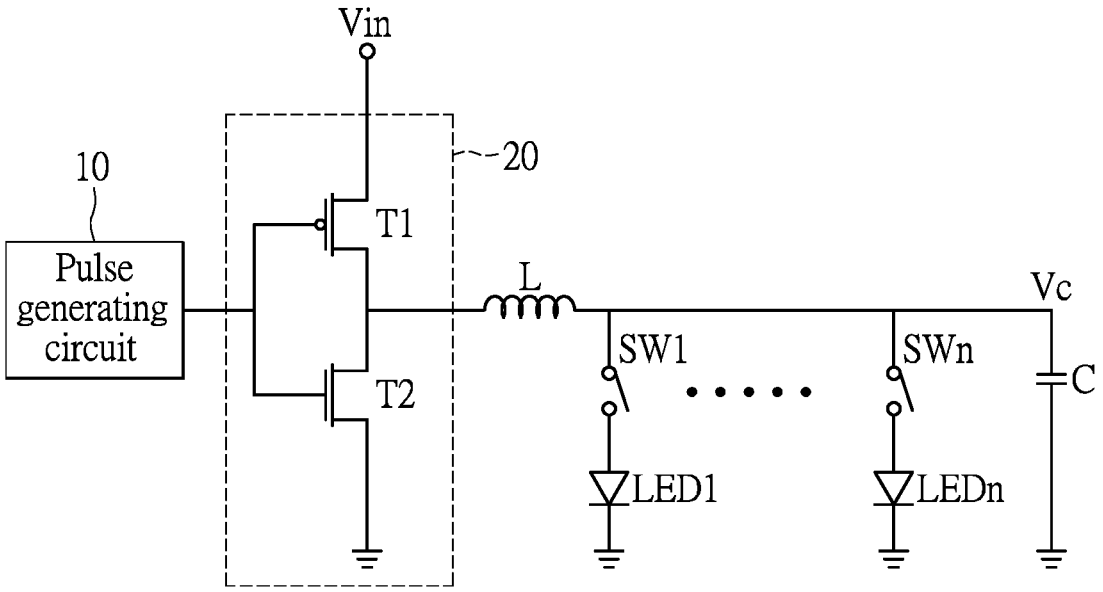
FIG. 5 is a circuit layout of a driver circuit with low inrush current according to a fifth embodiment of the present disclosure.

Reference is made to FIG. 5, which is a circuit layout of a driver circuit with low inrush current according to a fifth embodiment of the present disclosure. As shown in FIG. 5, the driver circuit with the low inrush current includes the pulse generating circuit 10, the light driving circuit 20, the output inductor L, the storage capacitor C, switch components SW1 to SWn and the light-emitting assembly. The light driving circuit 20 includes the transistors T1 and T2.

The light-emitting assembly includes several light-emitting components such as light-emitting diodes LED1 to LEDn, wherein n is any positive integer. The light-emitting diodes LED1 to LEDn may be connected to the switch components SW1 to SWn respectively. The number of the switch components SW1 to SWn may depend on the number of the light-emitting diodes LED1 to LEDn. The storage capacitor C is connected in parallel to the series circuit of the switch component SW1 and the light-emitting diode LED1.

Each of the charging current and the auxiliary current supplied by the light driving circuit 20 and the discharging current of the storage capacitor C may be divided into a plurality of shunt current. The shunt current may be outputted selectively to the light-emitting diodes LED1 to LEDn such that some or all of the light-emitting diodes LED1 to LEDn are driven at the same or different time points to synchronously or sequentially light up.

Figure 6:
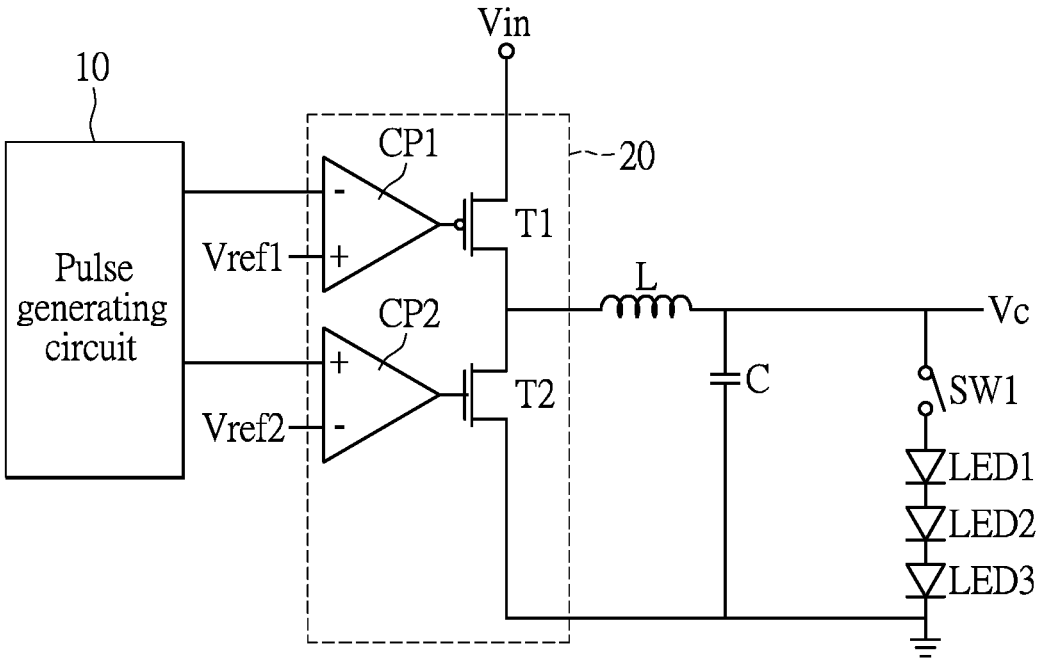
FIG. 6 is a circuit layout of a driver circuit with low inrush current according to a sixth embodiment of the present disclosure.

Reference is made to FIG. 6, which is a circuit layout of a driver circuit with low inrush current according to a sixth embodiment of the present disclosure. As shown in FIG. 6, the driver circuit with the low inrush current includes the pulse generating circuit 10, the light driving circuit 20, the output inductor L, the storage capacitor C, the switch components SW1 to SWn and the light-emitting assembly. The light driving circuit 20 includes the transistors T1 and T2 and comparators CP1 and CP2.

An inverting terminal of the comparator CP1 is connected to an output terminal of the pulse generating circuit 10. A non-inverting terminal of the comparator CP1 is connected to a reference voltage source Vref1. An output terminal of the comparator CP1 is connected to a gate terminal of the transistor T1. The source terminal of the transistor T1 is connected to the input voltage source Vin. The drain terminal of the transistor T1 is connected to one terminal of the output inductor L. The other terminal of the output inductor L is grounded through the storage capacitor C.

The light-emitting assembly is connected in series to the switch component SW1. The storage capacitor C is connected in parallel to the series circuit of the switch component SW1 and the light-emitting assembly. The light-emitting assembly may be a light strip including several light-emitting components such as light-emitting diodes LED1 to LED3 shown in FIG. 6, which are connected in series with each other toward the same direction.

On the other hand, a non-inverting terminal of the comparator CP2 is connected to an output terminal of the pulse generating circuit 10, and an inverting terminal of the comparator CP2 is connected to a reference voltage Vref2. An output terminal of comparator CP2 is connected to a gate terminal of the transistor T2. A drain terminal of the transistor T2 is connected to the drain terminal of the transistor T1. A source terminal of the transistor T2 is grounded.

When a voltage level of the pulse signal received by the comparator CP1 from the pulse generating circuit 10 is smaller than a reference level of the reference voltage source Vref1, for example, the voltage level of the pulse signal is 0 volt, the transistor T1 is turned off by a comparison result outputted from the comparator CP1.

On the contrary, when a voltage level of the pulse signal received by the comparator CP1 from the pulse generating circuit 10 is larger than the reference level of the reference voltage source Vref1, for example, the voltage level of the pulse signal is 5 volt, the transistor T1 is turned on by a comparison result outputted from the comparator CP1. At this time, the supplied charging current or auxiliary current is allowed to flow to the drain terminal of the transistor T1 from the source terminal of the transistor T1. Then, the charging current flows to the capacitor C through the output inductor L, and the auxiliary current flows to the light-emitting diodes LED1 to LED3 through the output inductor L.

On the other hand, when a voltage level of the pulse signal received by the comparator CP2 from the pulse generating circuit 10 is smaller than a reference level of the reference voltage source Vref2, the transistor T2 is turned off by a comparison result outputted from the comparator CP2. On the contrary, when a voltage level of the pulse signal received by the comparator CP2 from the pulse generating circuit 10 is larger than the reference level of the reference voltage source Vref2, the transistor T2 is turned on by a comparison result outputted from the comparator CP2. At this time, the supplied charging current or auxiliary current is allowed to flow to the transistor T2.

Figure 7:
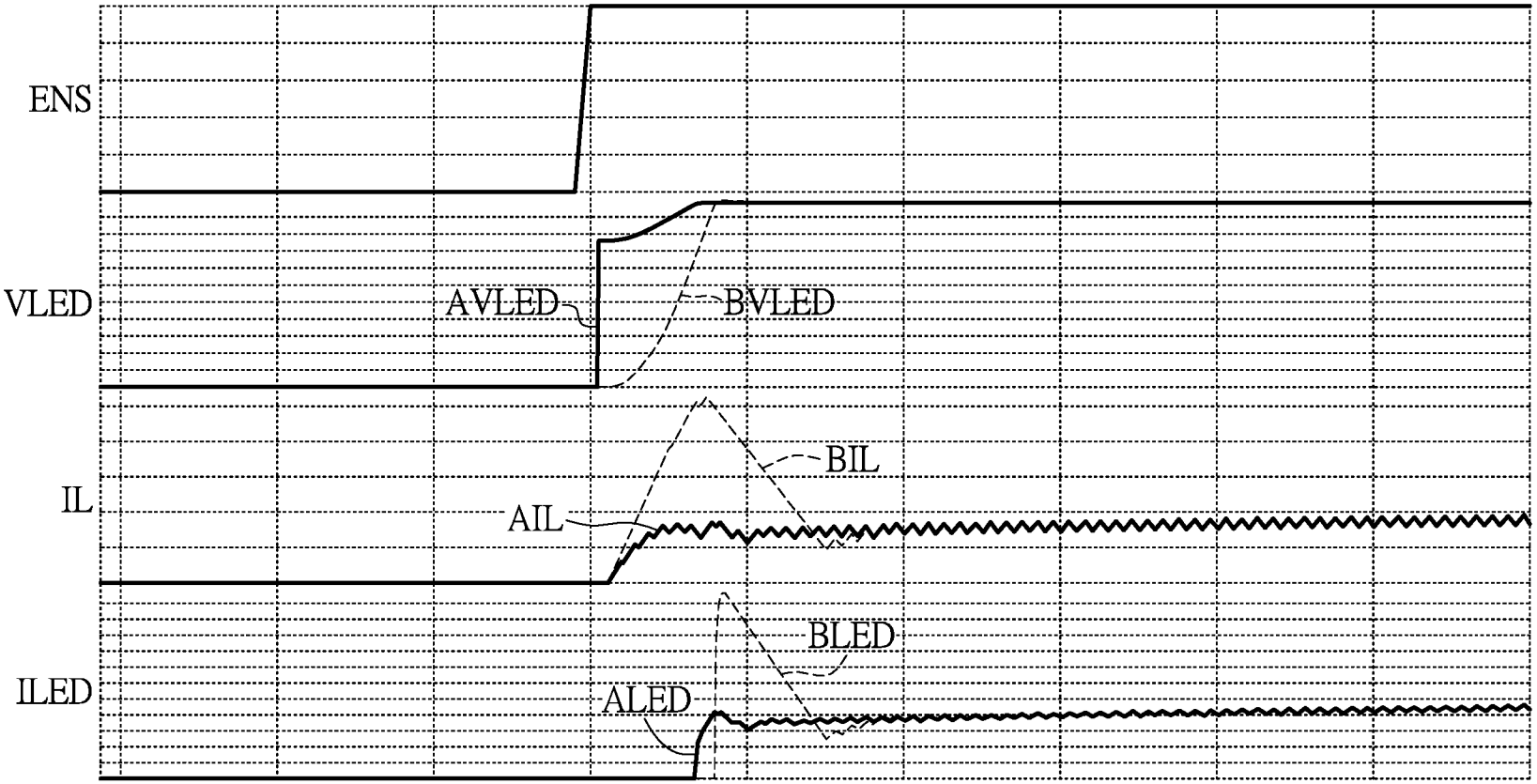
FIG. 7 is a waveform diagram of supplied voltages and current of the embodiments of the present disclosure and a conventional current driving circuit.

Reference is made to FIG. 7, which is a waveform diagram of supplied voltages and current of the embodiments of the present disclosure and the conventional current driving circuit. As shown in FIG. 7, ENS represents an enable signal generated by the pulse generating circuit 10, and the enable signal may be outputted to the light driving circuit 20 through the pin EN as shown in FIG. 1. VLED represents a voltage of each of the light-emitting assembly such as the above light-emitting components LED1 to LED3. IL represents a current of an inductor L. ILED represents a current through the light-emitting assembly.

It is worth noting that BVLED, BIL and BLED are generated by the conventional current driver circuit. BIL represents a high inrush current, which is supplied to the output inductor L through a light driving circuit from the input voltage source. BLED represents a current flowing through the light-emitting assembly.

In contrast, AVLED, AIL and ALED are generated by the driver circuit and the driving method with the low inrush current of the embodiments of the present disclosure. AIL represents two or more low inrush current divided from a high inrush current and supplied from the input voltage source. For example, the above charging current or auxiliary current is the low inrush current to be sequentially supplied to the light-emitting assembly through the light driving circuit and the output inductor. ALED represents the low inrush current flowing through the light-emitting assembly. The low inrush current AIL supplied to the output inductor of the driver circuit of the present disclosure is significantly smaller than the high inrush current BIL supplied to the output inductor of the conventional circuit. In addition, the low inrush current ALED flowing through the light-emitting assembly of the driver circuit of the present disclosure is significantly smaller than the high inrush current BLED flowing through the light-emitting assembly of the conventional driver circuit.

The conventional driving method supplies the high inrush current once to drive the light-emitting assembly to emit light. In contrast, beneficial effects of the driver circuit and the driving method with low inrush current of the present disclosure are that, the present disclosure supplies sequentially the low inrush current, each of which is smaller than the current threshold, to prevent the circuit components from being damaged by an excessively high inrush current flowing at once, so as to extend lifetimes of the circuit components.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A driver circuit with low inrush current, comprising:

a pulse generating circuit configured to output a pulse signal and a next pulse signal;

a light driving circuit connected to the pulse generating circuit and an input power source, and configured to receive the pulse signal from the pulse generating circuit, and sequentially receive a charging current and an auxiliary current from the input power source, wherein each of the charging current and the auxiliary current is smaller than a high inrush current;

an output inductor having one terminal connected to the light driving circuit;

a storage capacitor having one terminal connected to the other terminal of the output inductor and another terminal grounded, and configured to receive the charging current and be discharged to supply a discharging current based on the charging current;

a switch component having one terminal connected between the other terminal of the output inductor and the one terminal of the storage capacitor; and a light-emitting assembly connected in series to the switch component and a series circuit thus formed being connected in parallel to the storage capacitor, wherein the light-emitting assembly includes one or more light-emitting components connected in series with each other, and has a positive terminal connected to another terminal of the switch component and a negative terminal grounded;

wherein when a voltage level of the pulse signal reaches a reference level, the light driving circuit is configured to allow the charging current to flow to the storage capacitor through the light driving circuit until a voltage of the storage capacitor is charged up to be equal to an input voltage of the input power source;

wherein when a predetermined time passes after the voltage of the storage capacitor is charged up to be equal to the input voltage of the input power source, the next pulse signal reaches the reference level to turn on the switch component, and the discharging current of the storage capacitor flows sequentially through the switch component and the light-emitting assembly, the auxiliary current is allowed to flow sequentially to the switch component and the light-emitting assembly through the light driving circuit, such that the light-emitting assembly emits light by using the discharging current of the storage capacitor and the auxiliary current of input power source;

wherein a total amount of the charging current and the auxiliary current is equal to the high inrush current.

2. The driver circuit of claim 1, wherein the light driving circuit includes:

a first transistor having a first main control terminal connected to the pulse generating circuit, a first power input terminal connected to the input power source, and a first power output terminal connected to the one terminal of the output inductor; and a second transistor having a second main control terminal connected to the pulse generating circuit, a second power input terminal grounded, and a second power output terminal connected to the first power output terminal and the one terminal of the output inductor.

3. The driver circuit of claim 2, wherein the pulse generating circuit is configured to output a first pulse signal to the first transistor and a second pulse signal to the second transistor, the charging current includes a first shunt charging current and a second shunt charging current;

when a voltage level of the first pulse signal reaches a first reference level, the first transistor is turned on by the first pulse signal to allow the first shunt charging current to flow to the storage capacitor through the first transistor;

when a voltage level of the second pulse signal reaches a second reference level, the second transistor is turned on by the second pulse signal to allow the second shunt charging current to flow to the storage capacitor through the second transistor until the voltage of the storage capacitor is charged up to be equal to the input voltage of the input power source;

wherein the pulse signal includes the first pulse signal and the second pulse signal.

4. The driver circuit of claim 3, wherein the pulse generating circuit is configured to output a next first pulse signal to the first transistor and a next second pulse signal to the second transistor, the next pulse signal includes the next first pulse signal and the next second pulse signal, and the auxiliary current includes a first shunt auxiliary current and a second shunt auxiliary current;

when a voltage level of the next first pulse signal reaches the first reference level, the switch component and the light-emitting assembly are turned on by the next first pulse signal, the first shunt auxiliary current is allowed to flow to the switch component and the light-emitting assembly through the first transistor;

when a voltage level of the next second pulse signal reaches the second reference level, the second shunt auxiliary current is allowed to flow to the switch component and the light-emitting assembly through the second transistor.

5. A driving method with low inrush current, comprising the following steps:

supplying a charging current smaller than a high inrush current from an input power source;

outputting a pulse signal from a pulse generating circuit;

when a voltage level of the pulse signal reaches a reference level, receiving the charging current from the input power source by a light driving circuit, and allowing the charging current to flow to the storage capacitor through the light driving circuit until a voltage of the storage capacitor is charged up to be equal to an input voltage of the input power source;

when turning on the switch component, the storage capacitor is discharged, and then allowing the discharging current to flow to a light-emitting assembly through the switch component;

supplying an auxiliary current smaller than the high inrush current from the input power source;

when a predetermined time passes after the voltage of the storage capacitor is charged up to be equal to the input voltage of the input power source, a next pulse signal outputted by the pulse generating circuit reaches the reference level, receiving the auxiliary current from the input power source by a light driving circuit, and allowing the auxiliary current to flow sequentially to the switch component and the light-emitting assembly through the light driving circuit; and emitting light by the light-emitting assembly through the discharging current and the auxiliary current.

6. The driving method of claim 5, further comprising steps of: outputting a first pulse signal to a first transistor of the light driving circuit, and a second pulse signal to a second transistor of the light driving circuit, from the pulse generating circuit;

when a voltage level of the first pulse signal reaches a first reference level, the first transistor is turned on by the first pulse signal, allowing a first shunt charging current to flow to the storage capacitor through the first transistor; and when a voltage level of the second pulse signal reaches a second reference level, the second transistor is turned on by the second pulse signal, allowing a second shunt charging current to flow to the storage capacitor through the second transistor until the voltage of the storage capacitor is charged up to be equal to the input voltage of the input power source;

wherein the charging current includes the first shunt charging current and the second shunt charging current and the pulse signal includes the first pulse signal and the second pulse signal.

7. The driving method of claim 6, further comprising steps of:

turning on the first transistor and turning off the second transistor by the pulse generating circuit to allow the first shunt charging current to flow to the storage capacitor through the first transistor to charge the storage capacitor;

wherein the first shunt charging current is equal to the charging current.

8. The driving method of claim 7, further comprising steps of:

when a voltage level of a next first pulse signal outputted by the pulse generating circuit reaches the first reference level, and the switch component and the light-emitting assembly are turned on by the next first pulse signal, allowing a first shunt auxiliary current of the auxiliary current to flow to the switch component and the light-emitting assembly through the first transistor; and when a voltage level of a next second pulse signal outputted by the pulse generating circuit reaches the second reference level, the second transistor is turned on by the next second pulse signal, allowing a second shunt auxiliary current of the auxiliary current to flow to the switch component and the light-emitting assembly through the second transistor;

wherein the auxiliary current includes the first shunt auxiliary current and the second shunt auxiliary current and the next pulse signal includes the next first pulse signal and the next second pulse signal.

9. The driving method of claim 8, further comprising steps of:

turning on the first transistor and turning off the second transistor to allow the first shunt auxiliary current to flow to the switch component and the light-emitting assembly through the first transistor by the pulse generating circuit;

wherein the first shunt auxiliary current is equal to the auxiliary current.

* * * * *